US011060209B2

(12) United States Patent
Lee

(10) Patent No.: US 11,060,209 B2
(45) Date of Patent: Jul. 13, 2021

(54) CONTINUOUS STRAND OF FILAMENTS HAVING GRADIENT-LENGTH CHARACTERISTIC IMPLEMENTED BY KINKY TEXTURE AND SPIRAL ROTATIONAL TWIST, AND MANUFACTURING METHOD THEREFOR

(71) Applicant: YG CHEM CO., LTD., Seoul (KR)

(72) Inventor: Hae Ju Lee, Seoul (KR)

(73) Assignee: YG CHEM CO., LTD., Seoul (KR)

( * ) Notice: Subject to any disclaimer, the term of this patent is extended or adjusted under 35 U.S.C. 154(b) by 0 days.

(21) Appl. No.: 16/925,984

(22) Filed: Jul. 10, 2020

(65) Prior Publication Data

US 2020/0397079 A1 Dec. 24, 2020

Related U.S. Application Data

(63) Continuation of application No. PCT/KR2019/000665, filed on Jan. 16, 2019.

(30) Foreign Application Priority Data

Jan. 16, 2018 (KR) ..... 10-2018-0005511

(51) Int. Cl.
*A41G 3/00* (2006.01)
*D02G 1/00* (2006.01)
(Continued)

(52) U.S. Cl.
CPC ..... *D01F 6/00* (2013.01); *A41G 3/0083* (2013.01); *D02G 1/008* (2013.01); *D02G 1/028* (2013.01);
(Continued)

(58) Field of Classification Search
None
See application file for complete search history.

(56) References Cited

U.S. PATENT DOCUMENTS 3,910,291 A 10/1975 Kim
6,276,121 B1 8/2001 Nabeshima et al.
(Continued)

FOREIGN PATENT DOCUMENTS

GB 1082401 9/1967
JP 1994-287801 10/1994
(Continued)

OTHER PUBLICATIONS

International Search Report for International Application PCT/KR2019/000665, dated Jul. 17, 2019.
(Continued)

*Primary Examiner* — Shawn McKinnon
(74) *Attorney, Agent, or Firm* — Burris Law, PLLC

(57) ABSTRACT

Provided is a strand extending in the longitudinal direction, wherein the strand includes filaments of one type having a gradient-length effect through spiral rotational twists and an irregular fine texture through self-thermal shrinking. The filaments of the strand have natural coiling characteristics that are very similar to those of natural hair of black people, and these characteristics are caused by the facts that the filaments have 3-dimensional waveforms occurred due to many fine and irregular windings or projections and that the waveforms exhibit fractal structure features and a fine kinky texture.

18 Claims, 6 Drawing Sheets

(51) Int. Cl.

| | |
|---|---|
| ***D02G 1/20*** | (2006.01) |
| ***D02J 1/02*** | (2006.01) |
| ***D02J 1/06*** | (2006.01) |
| ***D02G 1/02*** | (2006.01) |
| ***D02G 1/18*** | (2006.01) |
| ***D01F 6/00*** | (2006.01) |
| ***D02G 3/02*** | (2006.01) |
| ***D02G 3/26*** | (2006.01) |
| ***D02G 3/34*** | (2006.01) |
| ***D02G 3/44*** | (2006.01) |

(52) U.S. Cl.

CPC ..... *D02G 1/18* (2013.01); *D02G 1/205* (2013.01); *D02G 3/02* (2013.01); *D02G 3/26* (2013.01); *D02G 3/34* (2013.01); *D02G 3/44* (2013.01); *D02J 1/02* (2013.01); *D02J 1/06* (2013.01); *D10B 2503/08* (2013.01)

(56) References Cited

U.S. PATENT DOCUMENTS

| | | | | |
|---|---|---|---|---|
| 6,841,245 | B2 | 1/2005 | Chang et al. | |
| 2007/0238389 | A1* | 10/2007 | Kobayashi | D02G 1/02 446/394 |
| 2011/0271976 | A1* | 11/2011 | Sasayama | A41G 5/0046 132/201 |
| 2012/0052219 | A1* | 3/2012 | Horihata | D01F 6/60 428/15 |
| 2013/0287990 | A1 | 10/2013 | Katagi | |
| 2017/0360133 | A1 | 12/2017 | Lee | |

FOREIGN PATENT DOCUMENTS

| | | |
|---|---|---|
| JP | 1997-302513 | 11/1997 |
| JP | H09302513 | 11/1997 |
| JP | 2002-317333 | 10/2002 |
| JP | 5509349 | 6/2014 |
| KR | 10-1993-0000056 | 1/1993 |
| KR | 10-2000-0016205 | 3/2000 |
| KR | 10-0671925 | 1/2007 |
| KR | 10-2017-0141571 | 12/2017 |

OTHER PUBLICATIONS

Written Opinion for International Application PCT/KR2019/000665, dated Jul. 17, 2019.

Office Action Issued in Corresponding KR Application No. 10-2019-0005956, dated May 17, 2019.

Office Action Issued in Corresponding KR Application No. 10-2019-0005956, dated Sep. 9, 2019.

European Search Report issued in corresponding EP Application No. 19741001.2, dated Sep. 3, 2020.

Office Action issued in corresponding EP Application No. 19741001.2, dated Nov. 6, 2020.

ARIPO Search Report issued in Application No. AP/P/2020/012345, dated Sep. 10, 2020.

* cited by examiner

CONTINUOUS STRAND OF FILAMENTS HAVING GRADIENT-LENGTH CHARACTERISTIC IMPLEMENTED BY KINKY TEXTURE AND SPIRAL ROTATIONAL TWIST, AND MANUFACTURING METHOD THEREFOR

CROSS-REFERENCE TO RELATED APPLICATIONS AND PRIORITY

This application is a continuation of PCT/KR2019/000665, filed on Jan. 16, 2019, which claims priority to and the benefit of Korean Patent Application No. 10-2018-0005511, filed on Jan. 16, 2018, in the Korean Intellectual Property Office. The disclosures of the above applications are incorporated herein by reference.

TECHNICAL FIELD

The present invention relates to a continuous strand of filaments for wigs imitating hair characteristics of black people. More particularly, the present invention relates to a continuous strand of monofilaments having a kinky texture and a pencil-shape effect (hereinafter, also referred to as "a gradient-length effect (GLE)") through a spiral rotational twist (hereinafter, also simply referred to as "a spiral twist") to closely imitate curly hair characteristics of hair of black people.

BACKGROUND

Various wig products have been presented according to different races, ages, and genders, where wigs are selected to have particular forms or shapes according to their purpose of use.

Currently, wigs for black people have been suggested in various forms or shapes, and such wigs are mainly provided as curl products styled primarily with curls or waves and braid products styled based on texture patterns. In recent years, special braid (SB) products have been presented in which curls and waves are provided in braid products with a texture, and most of the braid products market is moving toward the production of SB products.

A braid product is a basic product among wigs for black people. This product is worn by twisting with (twisting extension), braiding with (braiding extension), tying to (tying extension), or rubbing against (rubbing extension) the real hair of the wearer. To imitate natural hair of black people and for ease of connection and attachment of the wig, this product has a 3-dimensional spiral shape (or a coil-type) and basically has an irregular and fine texture.

The reason why such a most basic and common braid product in the wigs for black people market pursues a variety of textures is to similarly imitate the characteristics of the natural hair (or real hair) of black people, which has irregular and kinky coiling features. Particularly, it is important to prepare braid products with kinky coiling curls similar to those of natural hair of black people in order to make a connection part between real hair and false hair seem natural and facilitate attachment of the wig, thereby not giving an impression that a black consumer is wearing a wig. Since this facilitation of attachment of the braid product is not performed by using an adhesive or sewing to attach the braid product but is done by twisting or braiding the product with natural hair of the wearer, when the product does not have enough kinky coiling curls, there is a lack of tangling of the product in a process of braiding the product with natural hair of the wearer, and thus it may be difficult to perform the attachment. Also, the kinky coiling feature is a physical property that significantly contributes to the ease of handling when end-locking the endings of a wig by rubbing for beauty care or when rebraiding a wig after releasing monofilaments from strands.

In general, it takes several hours for a hairstylist to braid dozens of strands, and when most of filaments in strands do not have identical texture characteristics in this process, the braiding task may be very uncomfortable for the hairstylist. That is, all or at least most of filaments in a strand for wigs needs to have a texture having kinky coiling characteristics. This significantly contributes to aesthetic impression of the product as well as the convenience of braiding the braid product for black people.

Also, one of the main characteristics of a strand for wigs that most influence the style of a wig is the so-called pencil-shape effect, that is, a gradient-length effect (GLE), which helps in producing natural hairstyles. This means that fore-endings of filaments forming a strand for wigs have irregular lengths to produce natural hairstyles instead of having the same or regular lengths (wherein the fore-endings are terminals opposite to endings of the filaments attached to real hair of a wearer or are the lowermost terminals farthest away from hair roots of a wearer.) In particular, this effect means that a strand has a gradient as lengths of the filaments near a centerportion of the strand decrease, and lengths of the filaments located toward a sheath side of the strand increase when filaments of a strand are spread in a longitudinal direction and aligned side by side. As a result, when the fore-endings of the filaments are spread and then collected to the center line in the longitudinal direction of the strand, the fore-endings of the filaments form a tapered shape just like the shape of a sharp pencil.

Until now, attempts have been made to manufacture SB wig products having two important characteristics, a texture having kinky coiling features and a natural GLE, simultaneously in hairstyles of wigs for black people. Mainly two methods have been attempted to impart both a kinky coiling texture and a GLE.

The first method includes pressing monofilaments (in a tow state) by using a crimp machine having a press roll with bumps that imparts a desired texture to the filaments by using the thermoplastic characteristics of a thermoplastic polymer to obtain crimp-textured filaments. Next, the method includes cutting the filaments into a desired length and then combing with a hackle (a large-sized comb) to arrange the filaments of the same length in a longitudinal direction, where the filaments are misaligned. In doing so, a fore-ending portion of natural hair having the GLE described above may be produced. Then, to produce a style with a desired thickness, a predetermined quantity of the filaments are measured out and are wound around an aluminum pipe, and curls or waves are set on the filaments at a heat deflection temperature by using a hot air drier, thereby completing preparation of a curl braid product. However, this crimp texture has mold patterning or mold texture characteristics such as very regular micro-curls and/or waves, and thus the filaments with the crimp texture not only do not have a spiral twist effect but also have a texture that is significantly different from a fine and irregular kinky texture.

The second method includes cutting monofilaments and making them over-shrink at a temperature higher than the heat deflection temperature in a hot air drier to form a texture. Thereafter, the method includes measuring out a predetermined quantity of the filaments to make a bundle having a desired thickness and setting curls and/or waves on the filaments without GLE. Although the texture thus obtained is an irregular self-texture, the degree of its fineness or irregularity is far off from that of a fine and irregular kinky texture, thus the texture does not have a spiral twist effect, and tangling of the filaments may occur during hackle combing, which makes it difficult to obtain GLE through a misaligned arrangement. Therefore, the texture is not satisfactory.

Hereinafter, problems of the two methods will be described. In the first method, the texture formed by using a press crimp is mostly lost due to tension in a filament longitudinal direction applied to the filaments in later processes such as an aluminum pipe winding or braiding process for setting curls or waves, and a hair style is completed while the texture is further lost by heat applied thereto during the curl setting process, and thus it may be difficult to secure kinky and lightweight properties of the texture by using this method.

The second method may include heating the filaments such that the filaments do not melt and using residual shrinkage, and thus a texture may be induced to some degree by overshrinkage. Compare to a crimped texture, this texture is obtained by inducing shrinkage at a temperature higher than a heat deflection temperature, and thus texture-shape maintainability may be improved in a later process at a curl processing temperature (same as a heat deflection temperature), which may result in maintaining a bulky texture. However, such a bulky texture still may not achieve a fine and irregular kinky texture, and thus the texture is significantly not sufficient to express characteristics similar to those of natural hair of black people.

Also, after a large quantity of filaments is heat-treated at once, the filaments are combed by using a hackle for GLE in consideration of productivity in heat-treatment for the overshrinkage, but naturally overshrunk filaments tangle with one another as they are heat-shrunk, resulting in a state in which they are difficult to comb, and thus GLE of filaments for natural hairstyle may not be achieved. Therefore, the filaments having a bulky texture induced by the overshrinkage may be difficult to commercialize as they are. Instead, curly or wavy braid products may be manufactured by measuring a predetermined quantity of filaments and forming curls and waves through a post-process without expecting the products to have GLE. Also, it may be difficult for the products manufactured in this manner to have a fine and irregular kinky texture due to spiral coiling.

A wig-preparing process is a labor-intensive process that is directly influenced by the increase in payroll cost, and it has become a serious problem that quality uniformity may degrade due to manual production.

Japanese Patent Publication No. 1994-287801 discloses a method of preparing a crimped fiber for doll hair, the method comprising treating fibers having a residual shrinkage in a range of 5% to 70% with dry heat at a temperature in a range of 90° C. to 150° C. or with wet heat at a temperature in a range of 70° C. to 100° C.

Japanese Patent Publication No. 1997-302513 discloses a method of preparing crimped fibers for artificial hair, the method comprising mixing at least two different types of acrylic fibers or polyvinyl chloride fibers having different residual shrinkage to obtain mixed fibers; and dry-heat-treating or wet-heat-treating the mixed fibers to impart an irregular texture to the fibers.

U.S. Pat. No. 3,910,291 discloses artificial hair for use in wigs comprising a multiplicity of synthetic fibrous yarns each formed with a plurality of small waves having various sizes and extending in various directions. This patent uses a method of obtaining fine waves by tightly twisting strands including many fibrous yarns like in conventional rope making methods.

Japanese Patent Publication No. 2002-317333 discloses a method of preparing heat-shrinkable polyester-based artificial hair, wherein the method comprises melt-spinning and stretching a composition containing 80 wt % to 40 wt % of a polyalkylene terephthalate or a copolyester (A) mainly including a polyalkylene terephthalate and 20 wt % to 60 wt % of a polyarylate (B); and heat-treating the resultant in two stages.

In the conventional preparation methods, an irregular texture is induced by using fibers having different shrinkages or a fine waveform is obtained through tight twisting, but the methods may not provide strands of filaments that are similar to natural hair of black people and have both a kinky texture produced by a waveform formed of many fine and irregular windings and a GLE occurring due to spiral rotational twists. Therefore, filaments or strands consisting thereof are still needed to economically prepare wig products similar to natural hair of black people, wherein the filaments have both a kinky texture produced by a waveform formed of fine and irregular windings and a GLE due to spiral rotational twists.

SUMMARY

Provided is a strand including filaments with a texture similar to natural hair of black people by having both a kinky texture from waves formed by many fine and irregular windings and a gradient-length effect caused by spiral rotational twists.

Provided is a wig prepared by using the strand.

Provided is a method of preparing the strand.

According to an embodiment of the present invention, a strand may have a constant shape and may extend in one direction, wherein the strand may include 40 to 4,000 filaments of one type, wherein each of the filaments may include an amorphous organic polymer, a semi-crystalline organic polymer, or an alloy thereof, wherein an external diameter D of a cross-section of the strand may be in a range of 0.2 centimeters (cm) or more to 3.0 cm or less, the strand overall may have a spiral waveform caused by spiral rotational twists, wherein when the number of spiral rotational twists per meter is R (unit: number of rotation/m), a product of D and R (D*R) may be 180 (unit: cm·number of rotation/m) or less, a thickness of each of the filaments of the strand may be in a range of 30 denier (de) or more to 180 de or less, wherein each of the filaments may form a plurality of windings having irregular shapes and sizes by thermal shrinkage, wherein when waves formed by the plurality of windings are observed by a scanning electron microscope (SEM), the waves may be in irregular waveforms having irregular amplitudes and wavelengths;

wherein when the total number of the windings is N, a base of a triangle formed by connecting troughs and a peak of an $i^{th}$ winding of each of the filaments is Wi, and a height of the triangle of the $i^{th}$ winding is Hi, an average base of triangles of the windings is Mw=sum(Wi, where $1 \le i \le N$)/N, and an average height of the triangles of the windings is Mh=sum(Hi, where $1 \le i \le N$)/N, and when functions IR(P) each representing a percentage of windings+/−P % or more off from Mw and Mh are respectively defined as IRw(P) =sum(F(Wi), where $1 \le i \le N$)/N and IRh(P)=sum(F(Hi), where $1 \le i \le N)/N$, the strand may have an irregular texture that satisfies the condition of $IRw(0.05) \ge 0.05$ or $IRh(0.05) \ge 0.05$;

wherein, in the definition of the function IRw(P), when $x \ge (1+P)*Mw$ or $x \le (1-P)*Mw$, $F(x)=1$; or otherwise, $F(x)=0$;

wherein in the definition of the function IRh(P), when $x \ge (1+P)*Mh$ or $x \le (1-P)*Mh$, $F(x)=1$; or otherwise, $F(x)=0$;

wherein a value of the function IR(P) may be obtained from an A sampling section having a total length of 250 cm, wherein the A sampling section is obtained by adding the sums of hypotenuses of the triangles observed in each filament of ten filaments, in which the sum of hypotenuses of the triangles observed in each filament is selected to be 25 cm, wherein each of the ten filaments is randomly sampled at random locations in the strand having a randomly sampled length of 30 cm.

Preferably, $IRw(0.1) \ge 0.1$, or $IRh(0.1) \ge 0.1$.

According to an embodiment of the present invention, when evaluated against the A sampling section, the irregular texture and the spiral waveform caused by spiral rotational twists of the filaments of the strand may form a fractal structure. That is, the irregular texture and the spiral rotational twists may have a self-replicating property exhibited by the fractal structure.

According to an embodiment of the present invention, a characteristic of the fractal structure may be that the windings of the filaments and the spiral waveform proceed in the same direction.

According to an embodiment of the present invention, the irregular texture and the spiral waveform caused by spiral rotational twists may form a fractal structure in 70% or more, or, preferably, in 90% or more, of the A sampling section.

According to an embodiment of the present invention, when the strand is cut into a cylindrical shape having a circular cross-section with a diameter D and a length equal to 3D, the D*R of the strand may be in a range of 20 or more to 180 (unit: number of rotation/m) or less or, for example, in a range of 28.5 or more to 120 or less.

According to an embodiment of the present invention, a ratio of a real density (RD) to a bulk density (BD) may be in a range of 1.5 or more to 40 or less or, preferably, in a range of 2.0 or more to 25 or less.

According to an embodiment of the present invention, the triangles each formed by connecting troughs and a peak of each of the windings in the A sampling section may have an average base in a range of 0.25 millimeters (mm) or more to less than 6.5 mm, and an average height in a range of 0.25 mm or more to less than 6.5 mm, and an average area in a range of 0.03125 $mm^2$ or more to less than 12.5 $mm^2$.

According to an embodiment of the present invention, the triangles each formed by connecting troughs and a peak of each of the windings in the A sampling section may have an average base in a range of 0.25 mm or more to less than 4.5 mm and an average height in a range of 0.25 mm or more to less than 4.5 mm.

According to an embodiment of the present invention, the triangles each formed by connecting troughs and a peak of each of the windings in 70% or more, or, preferably, in 90% or more, of the A sampling section may have a base in a range of 0.25 mm or more to less than 6.5 mm and a height in a range of 0.25 mm or more to less than 6.5 mm.

According to an embodiment of the present invention, the triangles each formed by connecting troughs and a peak of each of the windings in 70% or more, or, preferably, in 90% or more, of the A sampling section may have a base in a range of 0.25 mm or more to less than 4.5 mm and a height in a range of 0.25 mm or more to less than 4.5 mm.

According to an embodiment of the present invention, the triangles each formed by connecting troughs and a peak of each of the windings in 70% or more, or, preferably, in 90% or more, of the A sampling section may have an area in a range of 0.03125 $mm^2$ or more to less than 12.5 $mm^2$.

According to an embodiment of the present invention, when the filaments forming the strand are aligned in a longitudinal direction while spreading the filaments by applying a force thereon, the filaments in a center portion of a cross-section of the strand may be extended the shortest in the longitudinal direction, the filaments may be extended further than an original length of the strand in the longitudinal direction as the filaments are further away from the center portion in a radial direction perpendicular to the longitudinal direction of the cross-section of the strand, and, as a result, a shape of the line resulting from connecting fore-endings of the filaments may be in a reversed V-shape when the filaments extending in the longitudinal direction are spread side by side in the longitudinal direction.

According to an embodiment of the present invention, when the filaments extending in a longitudinal direction are collected to the center line, which is in the longitudinal direction and passes through a center of the cross-section of the strand, fore-endings of the filaments may form a circular cone shape, and a vertex of the circular cone may be on the center line.

According to an embodiment of the present invention, when the strand is cut into a cylindrical shape having a circular cross-section having a diameter D and a length equal to 3D, a length L extending over the original length 3D of the strand may be 0.5D or more as the filaments in an outermost sheath side of the strand corresponding to the most distant part from the center linear spread in the longitudinal direction. Although the extended length L is not limited and does not need to be limited by an upper limit since the better GLE is resulted as the length L increases, the length L may be, for example, in a range of 0.5D or more to 5.0D or less or, for example, 0.5D or more to 3.5D or less.

According to an embodiment of the present invention, a length of the strand may be manufactured in the form of a continuous strand having a length of 0.5 meter (m) or more, wherein the continuous strand may have, for example, a length of 1 m or more, 2 m or more, 3 m or more, 4 m or more, or 5 m or more, but the length is not limited thereto, and, particularly, the length does not need to be limited by an upper end.

According to another embodiment of the present invention, provided is a wig including the strand according to an embodiment of the present invention.

According to another embodiment of the present invention, provided is a method of preparing a strand having a constant shape and extending in one direction, wherein the strand includes a plurality of filaments including an amorphous organic polymer, a semi-crystalline organic polymer, or an alloy thereof.

The method may include withdrawing a plurality of the filaments from a first winding roll by rotating the first winding roll around which a plurality of the filaments measured out to a desired quantity are each wound, while simultaneously imparting spiral rotational twists to the plurality of the filaments being withdrawn from the first winding roll by rotating the first winding roll in a manner that the left and right ends of the first winding roll exchange their positions; forming the strand by bundling the plurality of the filaments, and then thermally shrinking the filaments to form a texture occurring due to irregular windings in the strand by conveying the strand through a thermal shrinking section set at a temperature range that makes a shrinkage of the filaments in a range of 20% to 80%; cooling the strand to stabilize the spiral rotational twists and the texture occurring due to the irregular windings which are formed in the strand; and rewinding the strand around a second winding roll The method may further include inter-twisting a plurality of the strands that are simultaneously being manufactured to form curls in the strands by the intertwisting after separating the strands from one another or each other.

Special braid (SB) products having characteristics very similar to those of natural hair of black people may be economically produced by using a strand for wigs according to one or more embodiments of the present invention without a separate measuring process, a texturing process, and a separate pencil-shape effect imparting process through combing with a hackle. It is deemed that this is caused by spiral rotational twists and self-texturing imparted to the strand according to an embodiment during the preparation process. That is, the strand has a kinky texture very similar to that of natural hair of black people, wherein the kinky texture has a waveform formed of many fine and irregular windings as self-texturing of filaments of the strand is induced by minimizing a tension applied to the filaments in a thermal shrinkage process while maintaining a shape stability of the strand due to spiral rotational twists. At the same time, due to the spiral rotational twists of the strand, a natural hairstyle (a gradient-length effect (GLE) or a pencil-shape effect) having a V-shape, like a lead part of a sharp pencil, may be easily produced as the filaments are tangled when endings of the filaments in the strand are rubbed and pulled to be extended. Therefore, according to an embodiment of the present invention, a separate measuring process, a texturing process, and a pencil-shape effect imparting process in the preparation may be omitted from a strand preparation process, and thus SB products may be economically prepared.

Also, since filaments in the strand have a fine kinky texture caused by uniform self-texturing, attaching and braiding of the strand to real hair may be done very conveniently.

BRIEF DESCRIPTION OF DRAWINGS

FIGS. 4A to 4D are conceptual views of the strand according to an embodiment of the present invention, wherein the strand is cut into a cylindrical shape having a circular cross-section with a diameter D and a length or height H equal to 3D, wherein:

FIG. 4A shows a state in which the filaments 12 are spread side by side and extended in the longitudinal direction;

FIG. 4B shows a state in which the extended filaments are collected to the center line starting from the upper end of the cylindrical strand 10 having the height H equal to 3D;

FIG. 4C shows a state in which only the portions of the filaments extending beyond the height H equal to 3D are collected to the center line 15 starting from the lower end of the cylindrical strand 10 having the height H equal to 3D; and FIG. 4D shows a state in which a filament 17*a* located at the outermost portion of the strand is rotated once within an extended height H=3.5D and a filament 17*b* located at the outermost portion of the strand is rotated twice within the extended height H=3.5D from the state of FIG. 4B.

DETAILED DESCRIPTION OF EMBODIMENTS

Hereinafter, strands according to various exemplary embodiments of the present invention, and methods of preparing the strands will be described in detail. However, it should be understood that embodiments described herein should be considered in a descriptive sense only. Thus, it will be understood by one of ordinary skill in the art that various amendments or modifications may be made to the various exemplary embodiments. In description of the present invention, detailed descriptions about commonly known functions or elements will be omitted in order to avoid obscuring the main concept of the present invention.

As used herein, the terms "about", "substantially", or the like are to indicate numerical values proximate to the numerical values modified by the terms when permissible errors related to inherent preparation and material are provided. The terms are used to prevent unscrupulous infringers from unjustly using the disclosed content including an accurate or absolute numerical value and to provide better understanding of the present invention.

As used herein, filaments may include both monofilaments and multifilaments.

The present inventor has found that when a plurality of filaments being continuously measured and supplied are bundled together to form a strand while applying appropriate rotational twist to the strand, a shape retention of the strand may be secured. At the same time, the present inventor has noticed that tensions applied to filaments in a center portion and filaments in a surface portion are relevantly different due to the different radii of rotation of the center portion and the surface portion in a cross-section of the strand. The present inventor has completed the present invention based on a fact that a strand obtained by irregularly self-thermal shrinking filaments without restriction of a mold while minimizing the tensions applied to the strand, which have received the irregularly applied tensions, may internalize a gradient-length effect (GLE) by spiral rotational twists and has a fine texture by irregular self-thermal shrinking. The present inventor has also found that coiling characteristics very similar to those of natural hair of black people in the filaments of the strand thus obtained are caused by the fact that the filaments have a 3-dimensional waveform formed of many windings that are fine and irregular and that the waveform exhibits fractal structure characteristics and a fine and kinky texture. As used herein, the term "mold" may refer to a support, such as a pipe, or a frame.

Figure 1:
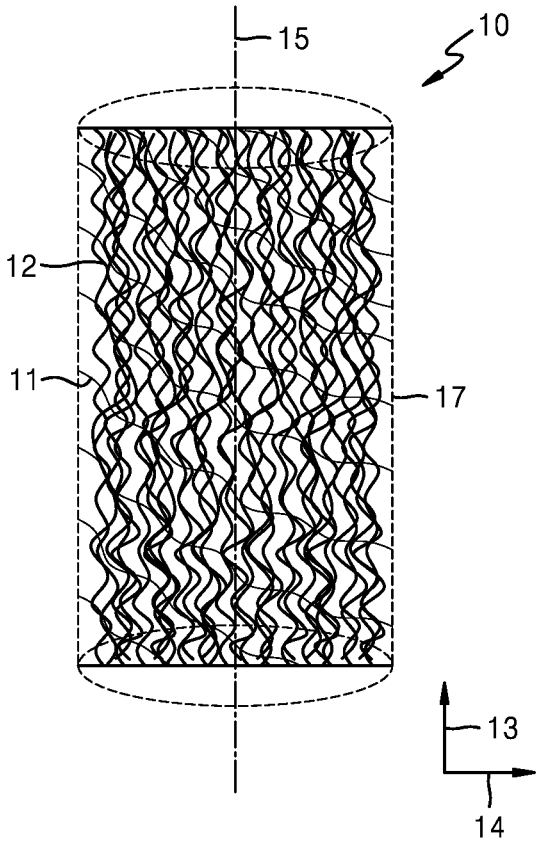
FIG. 1 is a schematic view of a strand according to an embodiment of the present invention.

FIG. 1 is a schematic view of a strand 10 according to an embodiment of the present invention. In FIG. 1, the reference number "13" denotes a longitudinal direction of the strand 10, and the reference number "14" denotes a radial direction of a cross-section of the strand 10 that is perpendicular to the longitudinal direction 13.

Referring to FIG. 1, the strand 10 may include a plurality of thermoplastic polymer filaments 12 that are bundled together generally in parallel to a center line 15. The filaments 12 exhibits a kinky texture shown by a waveform formed of many fine and irregular windings and spiral rotational twists 11. The filaments 12 may include or may be formed of an amorphous organic polymer, a semi-crystalline organic polymer, or an alloy thereof.

A polymer material that may be used in preparation of the filaments 12 may preferably include an amorphous organic polymer or a semi-crystalline organic polymer having a crystallinity of 30% or less or preferably 20% or less, but examples of the polymer material are not limited thereto, wherein the polymer material has high shrinkage characteristics so that the filaments 12 located even in the center portion of the strand 10 may sufficiently form a kinky texture. Specific examples of the polymer material may include polyvinyl chloride (PVC), polyvinylidene chloride (e.g. under the trade name MODACRYL), polyacrylonitrile (PAN), an acrylic resin, polycarbonate (PC), polymethyl methacrylate (PMMA), polystyrene (PS), an acrylonitrile-butadiene-styrene (ABS) resin, polyester, a styrene-acrylonitrile (SAN) resin, an acrylonitrile-styrene-acrylate (ASA) resin, polyacrylate (PAR), polyphenylene sulfide (PPS), or an alloy of two or more of these polymers. Examples of the alloy may include an alloy of PC and ABS, PC and polyethylene terephthalate (PET), or PC and PMMA. When a thermoplastic material that may result high shrinkage in unit time at a glass transition temperature is selected among the examples of the polymer, and when temperature and tension conditions needed for thermal shrinkage appropriate to characteristics of the selected material are controlled, the thermoplastic material may be used in preparation of the strand 10 according to an embodiment of the present invention.

For example, the strand 10 may include 40 to 4,000 filaments or, for example, 400 to 2,000 filaments. A shape of a cross-section of the strand 10 is generally a circle or an oval close to a circle. A diameter D of the circle may be in a range of 0.2 cm or more to 3.0 cm or less, for example, may be in a range of 0.5 cm or more to 2.0 cm or less. When the cross-section is an oval, a diameter D may be defined by an average value of the shortest diameter and the longest diameter. When the diameter D of the strand 10 is too small, the strand 10 may not be productized in the form of a strand. Also, when spiral rotational twist is applied to the strand 10, a difference between rotation diameters of the center portion, through which the center line 15 passes, and a sheath side 17 of the strand 10 is not large, and thus a gradient-length effect (GLE) may not be expected. That is, in this case, when the strand 10 is rotated during its preparation process, the desired spiral rotational twist effect may decrease since irregularity of tension applied to the filaments 12 between the center portion and the sheath side 17 is not large, and thus a satisfactory gradient-length effect and a desired kinky coiling texture may not be expected. When a diameter D of the strand 10 is too large, not only wearability of the strand 10 as a wig may decrease, but aesthetic impression of the strand 10 may not be expected as well.

A volume density of the strand 10 that is defined by a ratio of a real density (RD) to a bulk density (BD) is in a range of 1.5 or more to 40 or less, for example, 2.0 or more to 25 or less. The ratio denotes an apparent volume density or coverage rate of the strand 10, and when the ratio is within these ranges, the strand 10 may have sufficient kinky texture characteristics. This ratio is a value not particularly related to specific gravity of the polymer material constituting the filaments 12, wherein the value denotes a volume density of an appearance of the strand 10 that is formed by optimizing a self-texture and the number of rotations per meter (RTM). When the ratio is too low, a lightweight of the strand 10 may not be secured, and the filaments 12 of the strand 10 may not form a uniform kinky texture. The BD of the strand 10 itself may be in a range of 0.01 or more to 0.45 or less, for example, 0.05 or more to 0.35 or less.

The number of rotations per meter (RTM) according to a diameter D of the strand 10 significantly influence the volume density, and the present inventor has found that a value of D*RTM needs to be 180 or less, for example, 120 or less (unit: cm·number of rotation/m) to obtain the volume density within the above ranges through multiple times of experiments. Specifically, the strand 10 generally shows spiral waves caused by spiral rotational twists, and when the number of spiral rotational twists per unit meter of the strand 10 is referred to as R (unit: number of rotation/m), a product of D and R, i.e., D*R, may be 180 or less (unit: cm·number of rotation/m). For example, when the strand 10 is cut into a cylindrical shape having a circular cross-section having a diameter D and a length of 3D, the D*R of the strand 10 may be in a range of 20 or more to 180 or less (unit: number of rotation/m) or, for example, in a range of 28.5 or more to 120 or less. When the D*R is within these ranges, the ratio of a real density to a bulk density described above may be obtained as that of a strand having a satisfactory GLE as well as a kinky texture and fractal structure characteristics of natural hair of black people. That is, when the D*R is controlled to be within these ranges, a strand that may be used in preparation of braid products having a GLE, which contributes in production of a hairstyle with aesthetic impression. When the D*R is less than 20, an aesthetic GLE may not be obtained, external shape maintaining stability of the strand 10 may decrease, coiling characteristics of the filaments 12 may degrade, and the strand 10 may not have uniform fractal structure characteristics.

The RTM (an RTM reflected to the strand 10 after thermal shrinkage) itself imparted to the continuous strand 10 in a range of 30 RTM or more to 300 RTM or less, for example, 60 RTM or more to 200 RTM or less, or 20 RTM or more to 150 RTM or less may be preferable to maintain an appropriate external shape and to maintain an irregular kinky texture. When the RTM imparted to the strand 10 is too low, external shape maintainability of the strand 10 may degrade, which may deform the strand 10 during the preparation process and while a customer wearing the strand 10, and a GLE and a kinky texture may not be maintained. When the RTM imparted to the strand 10 is too high, a density of the strand 10 may be too high or an irregular and fine kinky texture may not be obtained as self-shrinkage of the strand 10 is restricted during a thermal shrinkage process.

The filaments 12 of the strand 10 may each have a fineness in a range of 30 denier (de) or more to 180 de or less, for example, 70 de or more to 180 de or less, or 90 de or more to 180 de or less. Here, the term "denier" denotes a weight (unit: g) of a 9000 m long-filament of a strand having spiral rotational twists and texture.

Figure 2:
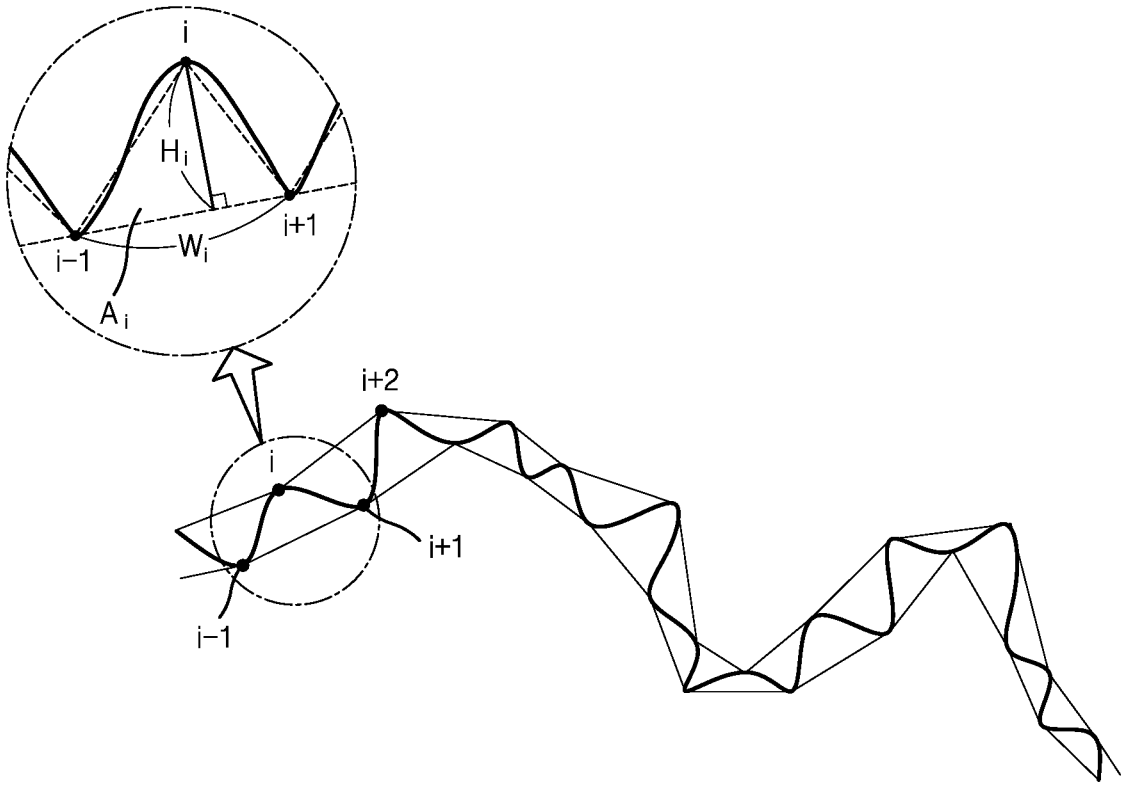
FIG. 2 is an enlarged side view illustrating a portion of a waveform represented by a plurality of windings of irregular shapes and sizes, wherein the windings are formed of one filament contained in the strand according to an embodiment of the present invention.

FIG. 2 is an enlarged side view illustrating a portion of a waveform consisting of a plurality of windings i−1, i, i+1, . . . of irregular shapes and sizes, wherein the windings are formed of any one of the filaments 12 contained in the strand 10 shown in FIG. 1. Referring to FIG. 2, the filaments 12 each forms the plurality of windings i−1, i, i−1, . . . having irregular shapes and sizes formed by thermal shrinkage. When a wave formed of the windings i−1, i, i+1, . . . is observed by a scanning electron microscope (SEM), the wave has an irregular waveform with irregular amplitudes and wavelengths.

Figure 3A:
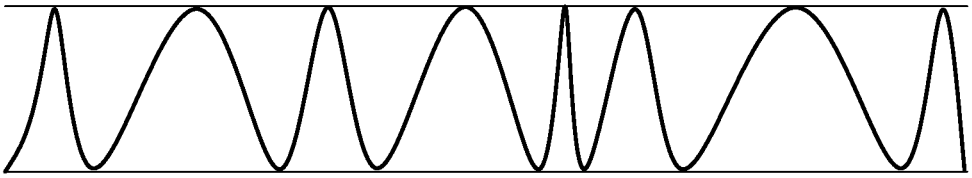
FIG. 3A show that a texture is irregular when widths (i.e., bases of triangles) varies despite of a constant height of windings forming the texture in a filament.
Figure 3B:
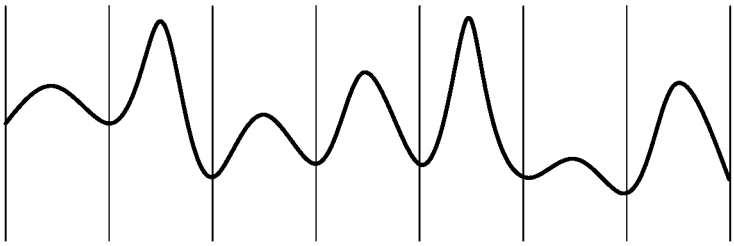
FIG. 3B show that a texture is irregular when heights of triangles varies despite of a constant width of the windings.

When the total number of the windings i−1, i, i+1, . . . is N, a base of a triangle formed by connecting troughs and a peak of an $i^{th}$ winding is Wi, a height of the triangle of the $i^{th}$ winding is Hi, an average of the bases is Mw=sum(Wi, where 1≤i≤N)/N, and an average of the heights is Mh=sum (Hi, where 1≤i≤N)/N, then functions IR(P) each representing a percentage of windings+/−P % or more off from Mw and Mh respectively may be defined as IRw(P)=sum(F(Wi), where 1≤i≤N)/N and IRh(P)=sum(F(Hi), where 1≤i≤N)/N. The strand 10 may have an irregular texture that satisfies the condition of IRw(0.05)≥0.05, or IRh(0.05)≥0.05. This represents a degree of irregularity where a percent of the windings each +/−5% or more off from Mw or Mh is +/−5% or more. Preferably, IRw(0.1)≥0.1, or IRh(0.1)≥0.1. This represents a degree of irregularity where a percent of the windings each +/−10% or more off from the average values Mw or Mh is +/−10% or more. These numerical ranges evaluates irregularity of a texture only by a base and a height of the triangle (i.e., only by an area of the triangle) without considering irregularity of shapes of the windings. However, although it may be difficult to quantify, when the irregularity of shapes of the windings, which are certain to exist in reality, is considered, and when the irregularity satisfies the numerical ranges above, a significantly irregular texture may be obtained. Thus, validity of the irregularity determining method by the quantification described above has been accepted in the art. For example, FIG. 3A shows that a texture may be irregular when widths (i.e., bases of triangles) varies despite of a constant height of windings forming the texture in a filament, and FIG. 3B shows that a texture may be irregular when heights of triangles varies despite of a constant width of the windings.

The texture having such an irregularity may exhibit an irregularity similar to that of kinky coiling of natural hair of black people. The irregular texture is a characteristic that may be obtained by using a self-texturing method which causes self-texturing of the strand 10 in a state of minimizing a tension applied to filaments without using a mold patterning method such as using a crimp machine. When an irregularity is not in the range defined above, attaching and braiding of a strand to real hair may be deteriorated, and the fact that the strand is made of a synthetic material may look noticeable, which may result difficulty in producing natural look. In this case, particularly, tangling of filaments does not occur during braiding of the strand, which requires much strength in fingers, and the resultant may be easily released.

Here, in the definition of a function IRw(P), when x≥(1+P)*Mw or x≤(1−P)*Mw, F(x) is equal to 1; or when x is otherwise, F(x) is 0. In the definition of a function IRh(P), when x≥(1+P)*Mh or x≤(1−P)*Mh, F(x) is equal to 1; or when x is otherwise, F(x) is 0.

Here, a value of the function IR(P) is obtained from an A sampling section having a total length of 250 cm, wherein the A sampling section is obtained by adding the sums of hypotenuses of the triangles formed by connecting troughs and a peak of windings i−1, i, i−1, . . . observed in each filament of ten filaments, in which the sum of hypotenuses of the triangles observed in each filament is selected to be 25 cm, wherein each of the ten filaments is randomly sampled at random locations in the strand having a randomly sampled length of 30 cm.

When evaluated against the A sampling section, the irregular texture and the spiral waveform caused by the spiral rotational twists of the filaments 12 of the strand 10 may form a fractal structure. That is, the irregular texture and spiral rotational twists may have a self-replicating property exhibited by the fractal structure.

One characteristic of the fractal structure is that in 70% or more, for example, in 90% or more of the A sampling section, the irregular texture and the spiral waveform caused by the spiral rotational twists may form a fractal structure. The fractal structure has a fractal dimension as one of its characteristics. This is a ratio of change in structural details of an object when a scale observing the object having fractal structure characteristics changes, and this ratio is an index that characterizes complexity of a fractal pattern. The fractal structure formed of the irregular texture and the spiral waveform caused by spiral rotational twists in the filaments 12 of the strand 10 according to an embodiment of the present invention may be in a fractal dimension higher than 1, for example, higher than 2.

The windings of the filaments 12 may appear to run in the same direction.

The irregular texture may have a fractal structure characteristic in 70% or more, for example, 90% or more of the A sampling section.

An average base length of triangles each formed by connecting troughs and a peak of each of the windings in the A sampling section, may be in a range of 0.25 mm or more to less than 6.5 mm, for example, 0.25 mm or more to less than 5.0 mm, 0.25 mm or more to less than 4.5 mm, 0.5 mm or more to less than 4.0 mm, or 0.5 mm or more to less than 3.0 mm; and an average height of the triangles may be in a range of 0.25 mm or more to less than 6.5 mm, for example, 0.25 mm or more to less than 5.0 mm, 0.25 mm or more to less than 4.5 mm, 0.5 mm or more to less than 4.0 mm, or 0.5 mm or more to less than 3.0 mm. When the filaments 12 in the strand 10 having the average values in these ranges above may exhibit a kinky texture caused by fine waves of the fine windings by self-thermal shrinkage. When these average values are less than the lower limits of the ranges, the filaments 12 may exhibit a fine texture but may be worthless due to a poor feeling to touch and poor visual aesthetics. When these average values are greater than the upper limits of the ranges, that is when an average base is 6.5 mm or more and an average height is 6.5 mm or more, the filaments 12 may not exhibit a fine and kinky texture but may stop at a state which is conventionally called as 'bulky texture' that has macro and rough touch feeling. In this case, a degree of exhibition of the kinky texture is low, and thus braiding and attaching properties of the filaments 12 may not reach desired levels, and aesthetic characteristics thereof may be degraded. Particularly, when an average base approaches the lower limit in a range of 0.25 mm or more to less than 6.5 mm as defined above, a kinky texture may easily exhibited.

A base of the triangles formed by connecting troughs and a peak of each of the windings in the A sampling section may be in a range of 0.25 mm or more to less than 4.5 mm, and a height of the triangles may be in a range of 0.25 mm or more to less than 4.5 mm.

In 70% or more, for example, 90% or more of the A sampling section, a base of triangles formed by connecting troughs and a peak of each of the windings in the A sampling section may be in a range of 0.25 mm or more to less than 6.5 mm, and a height of the triangles may be in a range of 0.25 mm or more to less than 6.5 mm.

In 70% or more, for example, 90% or more of the A sampling section, a base of triangles formed by connecting troughs and a peak of each of the windings in the A sampling section may be in a range of 0.25 mm or more to less than 4.5 mm, and a height of the triangles may be in a range of 0.25 mm or more to less than 4.5 mm.

The strand 10 according to the present invention has a characteristic that forms windings in an unspecified direction together with coiling of three-dimensional spiral, that is, characteristic of irregularly bent coiling, by having the constitutional features described above.

When the strand 10 according to the present invention is evaluated with respect to the A sampling section, the waveform caused by the irregular texture and spiral rotational twists may form a fractal structure. That is, the irregular texture and spiral rotational twists may have a self-replicating property exhibited by the fractal structure. Preferably, the characteristic of the fractal structure may appear while the windings of the filaments 12 and the spiral waveform proceed in the same direction. For example, the irregular texture and the spiral waveform caused by spiral rotational twists in 70% or more, for example, 90% or more of the A sampling section may form a fractal structure. That is, the irregular text and spiral rotational twists may have a self-replicating property that is exhibited by the fractal structure.

When viewed in a micro level as well as in a macro level (observed by zooming-in and zooming-out), a kinky coiling may exhibit a fractal structure characteristic. The fractal structure characteristic denotes a geometrical structure characteristic, where a partial view and a whole view of the object have the same shape. This is a process of producing a complex and subtle overall structure through repetition of a simple structure, where the process has characteristics of self-similarity and recursiveness. As described above, a fractal structure from the irregular texture and the spiral waveform caused by spiral rotational twists in the filaments 12 of the strand 10 according to the present invention may have a fractal dimension higher than 1, for example, higher than 2.

Figure 4A:
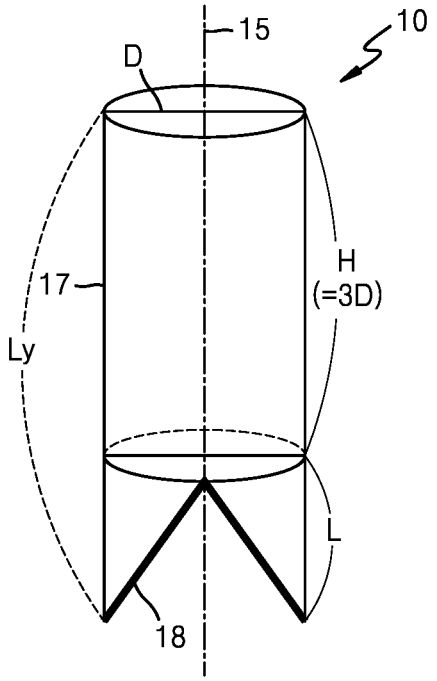
Figure 4B:
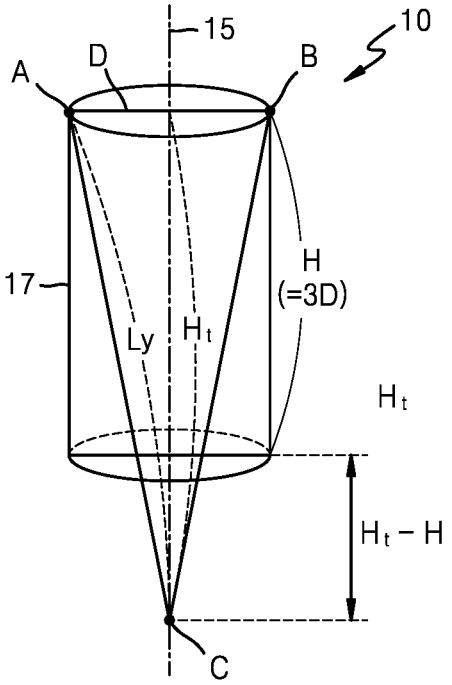
Figure 4C:
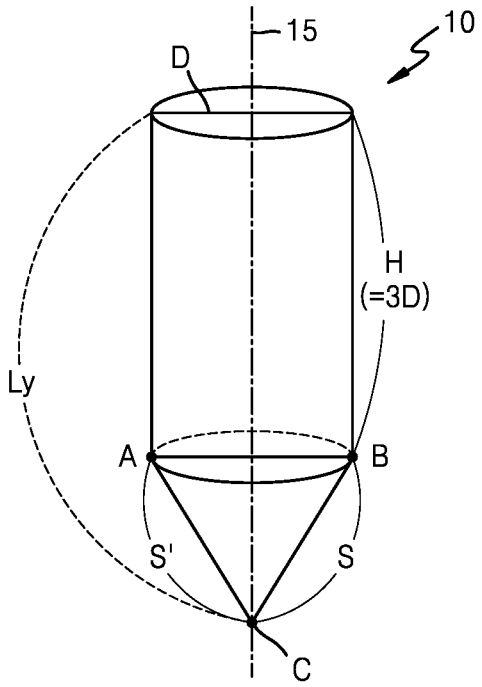
Figure 4D:
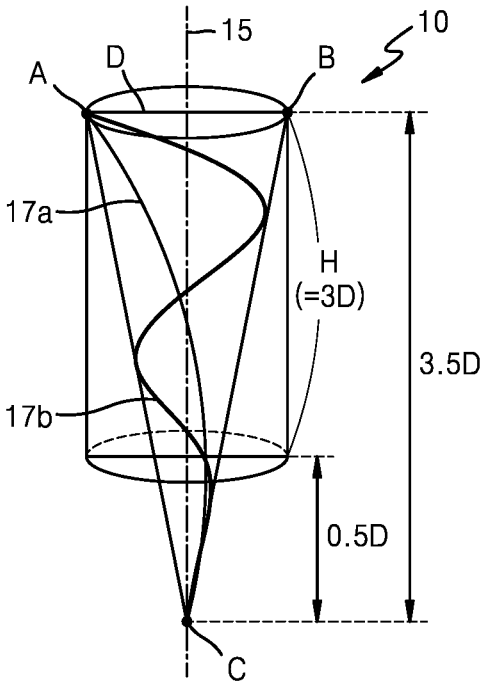

FIGS. 4A to 4D are conceptual views of the strand 10 according to an embodiment of the present invention, wherein the strand 10 is cut into a cylindrical shape having a circular cross-section with a diameter D and a length or height H equal to 3D, wherein FIG. 4A shows a state in which the filaments 12 are spread side by side and extended in the longitudinal direction, FIG. 4B shows a state in which the extended filaments are collected to the center line starting from the upper end (line AB) of the cylindrical strand 10 having the height H equal to 3D, FIG. 4C shows a state in which only the portions of the filaments extending beyond the height H equal to 3D are collected to the center line 15 starting from the lower end (line AB) of the cylindrical strand 10 having the height H equal to 3D, and FIG. 4D shows a state in which a filament 17*a* located at the outermost portion of the strand is rotated once within the extended height H=3.5D from the state of FIG. 4B, and thus has a spiral rotational twist of one rotation; and a filament 17*b* located at the outermost portion of the strand is rotated twice within the extended height H=3.5D from the state of FIG. 4B, and thus has a spiral rotational twist of two rotations.

Referring to FIG. 4A, when a force is applied to the filaments 12 forming the strand 10 to spread the windings and align the filaments 12 in a straight line, the filaments 12 located in a center portion of the cross-section of the strand 10 are extended shortest in the longitudinal direction 13, whereas the filaments 12 located further away from the center line 15 in a radial direction 14 of the cross-section of the strand 10 perpendicular to the longitudinal direction 13 further extends exceeding the original length of the strand 10. In this manner, the filaments 12 located at a sheath side 17, which is an outermost portion of the strand 10, are extended the longest, and this is represented by a length "Ly" in FIG. 4A. L denotes only an extended portion of a length of the filaments 12 in the sheath side 17 exceeding a lower end of the strand 10 having a height H=3D. As a result, when the filaments 12 extending in the longitudinal direction 13 are spread side-by-side in the longitudinal direction 13, a shape of the line connecting the fore-endings of the filaments 12 may be in a reversed V-shape 18 as shown in FIG. 4A.

When the strand 10 is cut into a cylindrical shape having a cross-section with a diameter D and a length 3D, and when the filaments 12 located at the sheath side 17 of the strand 10 are aligned along the longitudinal line 13 by spreading out the windings, wherein the sheath side 17 is the most distant portion from the center line 15, the extended portion L exceeding the original length 3D of the strand 10 is not particularly limited; and, particularly, an upper limit of the length L is not limited since the better GLE is resulted as the length L increases, wherein the length L may be, for example, in a range of 0.5D or more to 5.0D or less, for example, 0.5D or more to 4.0D or less, 0.5D or more to 3.5D or less, 0.5D or more to 3.0D or less, 0.5D or more to 2.5D or less, 0.5D or more to 2.0D or less, or 0.5D or more to 1.5D or less. In this regard, the strand 10 may exhibit GLE in addition to a kinky texture by fine and irregular spiral coiling. This will be considered in detail as follows.

Referring to FIG. 4B, when the filaments 12 extending in the longitudinal direction 13 from the upper end line AB of the cylindrical strand 10 are focused to the center line 15 along the longitudinal direction 13 that passes the center of the cross-section of the strand 10, an overall shape of the filaments 12 may be a circular cone, and an apex C of the circular cone may be located on the center line 15. In FIG. 4B, an isosceles triangle formed of points A, B and C will be considered, wherein the points A, B and C may be obtained when the outermost filaments (having R which is the number of rotations per unit length (1 m)) of the cylindrical strand 10 are spread in a straight line. A height of the triangle Ht may be expressed according to Equation 1.

$$H_t = \sqrt{L_y^2 - \left(\frac{D}{2}\right)^2} = \sqrt{H^2 + (\pi DRH)^2 - \left(\frac{D}{2}\right)^2} \quad \text{Equation 1}$$

As the height Ht of the triangle is greater than a length H of the strand 10, an aesthetic pencil-shape effect may increase. A factor alpha (α) for quantity evaluation of the aesthetic pencil-shape effect may be defined by Equation 2.

$$\alpha = \frac{H_t - H}{D} = \frac{\sqrt{H^2 + (\pi DRH)^2 - \left(\frac{D}{2}\right)^2} - H}{D} \quad \text{Equation 2}$$

When a value of α is 0.5 or more, for example, 1.0 or more, the strand 10 may be evaluated as having an aesthetic pencil-shape effect, and when a height H of the strand 10 is 3D, α may be expressed according to Equation 3.

$$\alpha = \left(\sqrt{9(1 + (\pi DR)^2) - \frac{1}{4}} - 3\right) \quad \text{Equation 3}$$

FIG. 4C shows a state when only the portions of the filaments 12 extending beyond the height H=3D, i.e., beyond the lower end (line AB) of the cylindrical strand 10, are collected to the center line 15. An overall shape of the filaments 12 is a small circular cone, and an apex C of the circular cone may be located on the center line 15.

In an isosceles triangle formed of points A, B and C shown in FIG. 4C (i.e., S'=S in FIG. 4C), when a hypotenuse line AC is longer than a base line AB (i.e., a diameter D), an aesthetic GLE may increase. A factor beta (β) defined by dividing the length of hypotenuse AC with the length of the base AB=D (i.e., β=AC/D) may be expressed according to Equations 4 and 5 to quantify and evaluate the aesthetic pencil-shape effect.

$$\beta = \frac{L_y - H}{D} \qquad \text{Equation 4}$$

$$\beta = \frac{\sqrt{H^2 + (\pi DRH)^2} - H}{D} = \sqrt{\left(a + \frac{H}{D}\right)^2 + \left(\frac{1}{2}\right)^2} - \frac{H}{D} \qquad \text{Equation 5}$$

The larger the beta (β) value, the greater the aesthetic effect, and when a value of β is 0.5 or more, for example, 1.0 or more, the strand 10 may be evaluated as having an aesthetic pencil-shape effect. When a height H of the strand 10 is 3D, β may be expressed according to Equation 3.

$$\beta = 3\left(\sqrt{1+(nDR)^2} - 1\right) = \sqrt{(\alpha+3)^2 + (1/2)^2} - 3 \qquad \text{Equation 6}$$

Reference is made to FIG. 4D which shows a state in which a filament 17*a* located at the outermost portion of the strand 10 is rotated once within the extended height H=3.5D and thus has a spiral rotational twist of one rotation and a filament 17*b* located at the outermost portion of the strand 10 is rotated twice within the extended height H=3.5D and thus has a spiral rotational twist of two rotations. When the filament (having R, which is the number of rotation per unit length (1 m)) located at the outermost portion of the cylindrical strand 10 having a diameter D and a height 3D is spread in a straight line, and when the length of the spread filament 17*a* is long enough to rotate around a circumference of a virtual cone ABC having a diameter D and a height 3.5D, the strand 10 may have an aesthetic pencil-shape effect. Thus, in this geometry, a factor gamma (γ) for quantity evaluation of an aesthetic pencil-shape effect may be defined by dividing a length Ly obtained by spreading the outermost filament in a straight line with a length of spiral $L_0$ that is rotated once around the virtual cone having a diameter D and a height 3.5D. Then, γ may be represented by Equation 7.

$$\gamma = \frac{L_y(H_y = 3D)}{L_0(H_o = 3.5D)} = \frac{6\sqrt{1 + (\pi DR)^2}}{u\left(\sqrt{1+v} + v\log_e\left(\sqrt{1+v} + 1\right) - v\log_e\left(\sqrt{v}\right)\right)} \qquad \text{Equation 7}$$

In Equation 7, u and v are values represented as below.

$$u = \pi DRH_o = 3.5\pi D^2 R, \quad v = \frac{D^2 + 4H_o^2}{4(\pi DRH_o)^2} = \frac{50}{49(\pi DR)^2}$$

In the same manner, when a value of γ is 0.5 or more, for example, 1.0 or more, the strand 10 may be evaluated as having an aesthetic pencil-shape effect.

A relationship between the three factors α, β and γ may be represented by Equations 8 and 9.

$$\gamma = \frac{2(\beta + 3)}{u\left(\sqrt{1+v} + v\log_e\left(\sqrt{1+v} + 1\right) - v\log_e\left(\sqrt{v}\right)\right)} \qquad \text{Equation 8}$$

$$\gamma = \frac{\sqrt{4(\alpha + 3)^2 + 1}}{u\left(\sqrt{1+v} + v\log_e\left(\sqrt{1+v} + 1\right) - v\log_e\left(\sqrt{v}\right)\right)} \qquad \text{Equation 9}$$

In the equations of the three pencil-effect related factors, it may be known that all three equations have D*R as a dependent variable. Thus, the range of D*R values may be used as a criterion to determine whether any strand infringes the standard of a pencil-shape effect according to the present invention or not. When each value of the three factors is 0.5 or more, it may be seen that an aesthetic pencil-shape effect commonly told in the wig industry appears. When the D*R defined above in the present invention is within the preferable range, all values of the three factors may each be 1.0 or more. That is, we have confirmed that when the D*R value was within a range of 20 or more to 180 or less, the α, β and γ factors were all be 0.5 or more. Preferably, we have confirmed that when the D*R value was within a range of 28.5 or more to 120 or less, the α, β and γ factors were all 1.0 or more, thus the best pencil-shape effect was obtained.

The strand 10 may be manufactured in the form of a continuous strand having a length of 0.5 m or more. The length is not particularly limited, and in particular, there is no need to limit the upper limit thereof, but for example, the continuous strand may have a length of 1 m or more, 2 m or more, 3 m or more, 4 m or more, or 5 m or more.

In the present specification, the filament sampling for various evaluations may be theoretically completed by the 'A sampling method' defined as above. However, in order to actually perform the evaluations, even if the 'A sampling' method is replaced by a method referred to as 'B sampling' by the inventor, the same result may be obtained. Therefore, instead of the A sampling method, the B sampling method may be used to determine whether any strand falls within the scope of the claims. The B sampling method is a sampling method that evaluates the whole section of ten filaments randomly sampled at the outermost portion of a randomly sampled strand having a length of 30 cm, for convenience of sampling.

Next, a method of preparing a strand according to the present invention having the structural characteristics described above by referring to FIG. 5.

Figure 5:
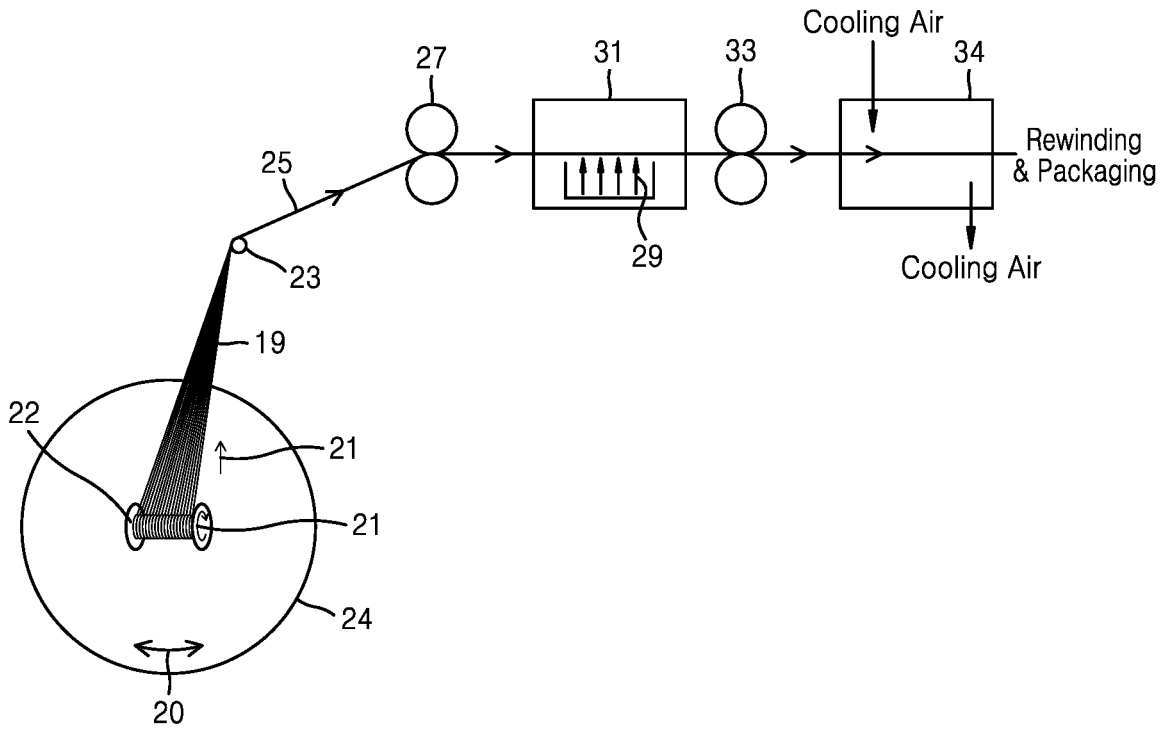
FIG. 5 is a schematic flowchart for describing a method of preparing a strand according to an embodiment of the present invention.

FIG. 5 is a schematic flowchart to describe a method of preparing a strand according to an embodiment of the present invention.

First, a first winding roll 22, on which a plurality of filaments 19 measured out to a desired quantity (at a predetermined denier) are separately wound, may be rotated 21 to withdraw the plurality of filaments 19 from the first winding roll 22 and to supply the filaments 19 to a thermal shrinking section 31. At the same time, the first winding roll 22 may also be rotated in a second rotation direction 20 different from the first rotation direction 21 for withdrawing the filaments 19 from the first winding roll 22 to impart spiral rotational twists and/or curls to a strand 25 including the plurality of filaments 19. For example, spiral rotational twists and/or curls may be imparted to the withdrawn filaments 19 by rotating the first winding roll 22 in a manner that both ends of the first winding roll 22 exchange their locations. To impart spiral rotational twists and/or curls in this manner, a disc 24 on which the first winding roll 22 is disposed may be rotated in the second rotation direction 20. The number of the spiral rotational twists imparted to the strand 25 may be controlled by controlling a speed of the second rotation direction 20 of the disc 24.

In FIG. 5, a method of preparing a strand by disposing one first winding roll 22 on one disc 24 for clarity of the description. However, embodiments of the present invention are not limited thereto, and thus a plurality of first winding rolls 22 may be disposed on one disc 24 to simultaneously manufacture a plurality of strands in parallel. Alternatively, a plurality of discs 24, on each of which the first winding roll 22 is disposed, may be used to simultaneously manufacture a plurality of strands in parallel. Also, a small disc (not shown) may be disposed on one disc 24, and at least one first winding roll 22 may be disposed on the small disc so that a strand product having cross-twist may be prepared by using both revolution and rotation of the discs and the winding roll. For example, the first winding roll 22 may be disposed on the small disc (also, referred to as "a first winding set"), and a plurality of the small discs may be disposed on one large disc. In this disposition, when the first winding roll 22 is rotated in a second direction and rotational twists are applied to a strand withdrawn out in a first direction, and the large disc, on which a plurality of the first winding sets are disposed, is revolved in a third direction, cross-twist, in other words, inter-twist may be imparted to each strand of the strands. In this case, since the strands are withdrawn while rotation directions of the small disc and the large disc are the same or different from one another or each other and are conveyed through a thermal shrinking section, rotational curls and waves caused by a waveform of the inter-twist (also, referred to as a "mold waveform") may be imparted to the strands (when the inter-twists acting as mutual molds on the strands are released after being imparted to the strands), as well as a kinky coiling texture and a pencil-shape effect. Also, irregular waves may be imparted to the strands by controlling tensions applied to the strands in a continuous process. In this case, directions and magnitudes of rotation of the small disc or the first winding set and those of revolution of the large disc may be appropriately controlled to separate or combine the strands.

In this regard, when the plurality of first winding rolls 22 is disposed, a plurality of second winding rolls (not shown) described below may be prepared to individually rewind the continuous strands while being manufactured.

The strands 25 simultaneously being prepared may be separated or combined by appropriately controlling the directions and rotation speeds of the first rotation direction 21 and the second rotation direction 20 described above. Strands of a kinky texture having various styles of pencil-shape effect (i.e., GLE) may be manufactured by controlling the total deniers of the quantified filaments on the first winding rolls 22 and the speeds of the first rotation direction 21 and the second rotation direction 20. When these strands are cut and packed, SB products of various styles may be manufactured in an automatic manner, and thus the products may be manufactured economically and in a large scale.

The plurality of filaments 19 may be collected by using a guide roll 23 to form the strand 25, and the strand 25 may be conveyed through a thermal shrinking section 31 set at a temperature range such that a shrinkage rate of the filaments 19 is in a range of 20% to 80%, for example, 40% to 70% to thermally shrink the filaments 19. Here, the filaments 19 each forms a plurality of windings having irregular shapes and sizes, and the tension applied to the filament 19 along the direction of travel is reduced so that the wave formed by the windings may exhibit an irregular waveform whose amplitudes and wavelengths are not constant when observed through a SEM. For this, a tension applied to the filaments 19 of the strand 25 and/or a residence time in the thermal shrinking section 31 may be appropriately controlled by controlling the rotation speed of a pair of first nip rolls 27 located outside of an inlet of the thermal shrinking section 31 and the rotation speed of a pair of second nip rolls 33 located at an outside of an outlet of the thermal shrinking section 31. As used herein, a shrinkage rate of the filaments 19 is a value that is measured by a dry heating method in which the filaments 19 are treated for twenty minutes at a temperature which is the same as that set in the thermal shrinking section 31, and the lengths of the filaments 19 are measured to calculate a shrinkage rate.

In the thermal shrinking section 31, hot air 29 may be applied to the filaments 19 in a direction vertical to the travel direction to reduce, or, preferably, minimize, a tension in the travel direction applied to each of the filaments 19 and to separate the filaments 19 individually as much as possible so that the filaments 19 may actively self-shrink with the least restriction.

Here, the strand 25 may maintain a circular cross-section by thermal shrinkage and spiral rotational twists that are performed not to include a hallow core in the strand 25, or, if needed, the strand 25 may be conveyed through pressure nip rolls (not shown) in the thermal shrinking section 31 so that the strand 25 may have a flat cross-section.

In a cooling section 34, spiral rotational twists and an irregular waveform imparted to the strand 25 may be set. For this, the strand 25 may be lightly pressed by using a roll-to-roll tension or another appropriate process while circulating an air flow, preferably, a cold air flow in the cooling section 34 to prevent the spiral rotational twists and the irregular waveform that lead to a kinky coiling texture having a spiral irregularity from being messy and tangled.

When the strand 25 goes through a thermal crimp roll (not shown) having a nib interval in a range of 2 mm to 20 mm before and after the cooling section 34, the strand 25 may have an appearance having wavy curls in a longitudinal direction of the strand 25 along with spiral rotational twists.

The filaments in the continuous strand thus obtained may be formed of one type of filaments. Alternatively, the filaments may be formed of at least two different filaments having shrinkages different from one another or each other. In this case, when such different filaments having different shrinkage are used together with inter-rotation of the filaments, the thermal shrinkage then occurred may be further irregular, so that the strand 25 may have an appearance having wavy curls in a longitudinal direction of the strand 25 in addition to a further irregular kinky texture, spiral rotational twists, and a pencil-shape effect.

Lastly, the strand 25 according to the present invention having a stable appearance and a kinky coiling texture may be rewound on the second winding roll (not shown), and then the strand 25 is released in the opposite direction to be cut in an appropriate length and packaged.

EXAMPLES OF EMBODIMENTS

The present invention will now be described in more detail with reference to the following examples. However, these examples are not intended to limit the scope of the present invention.

Examples

First, three types of a yarn for wigs having shrinkages described below were prepared. A denier (de) of the filament yarns denotes a weight (unit: g) of a 9000 m long filament.

Yarn for Wigs 1

Polyvinyl chloride (PVC) having a degree of polymerization of 1000, a conventional flow improver, a conventional thermal stabilizer, and a conventional antioxidant were put into a 65 mm diameter twin-screw extruder (having a length (L)/a diameter (D)=28), and the mixture was compounded to obtain PVC pellets. The PVC pellets were extruded and spun in a 50 mm diameter single-screw extruder, and then undrawn yarns of 42,000 de/300 filaments (F) (140 de/monofilament) were collected in a container. Roll-to-roll 2.5 times extension and thermal setting were performed on the undrawn yarns of about 30,000 filaments housed in 100 containers in a multi-stage horizontal thermal chamber to obtain Yarn for wigs 1 of 1,680,000 de/30,000 F (56 de/monofilament) having a shrinkage of 45% at a temperature of 130° C.

Yarn for Wigs 2

PVC having a degree of polymerization of 1000, a conventional flow improver, a conventional thermal stabilizer, and a conventional antioxidant were put into the twin-screw extruder, and the mixture was compounded to obtain PVC pellets. The PVC pellets and an ABS resin having a good compatibility with the PVC pellets were alloy-compounded in a 65 mm diameter single-screw extruder at a weight ratio of 70:30 (PVC:ABS). The alloy pellets thus obtained were extruded and spun in the 50 mm diameter single-screw extruder, and then undrawn yarns of 42,000 de/300 filaments (F) (140 de/monofilament) were collected in a container. Roll-to-roll 2.5 times extension and thermal setting were performed on the undrawn yarns of about 30,000 filaments housed in 100 containers in a multi-stage horizontal thermal chamber to obtain Yarn for wigs 2 of 1,680,000 de/30,000 F (56 de/monofilament) having a total shrinkage of about 50% at a temperature of 130° C.

Yarn for Wigs 3

The PC resin and PET were mixed at a weight ratio of 60:40 in the 65 mm diameter twin-screw extruder, and the mixture was compounded with a compatibilizer that may chemically bind terminal groups of the two polymers to obtain PC/PET alloy pellets. The alloy pellets were extruded and spun in a 50 mm diameter single-screw extruder, and then undrawn yarns of 42,000 de/300 filaments (F) (140 de/monofilament) were collected in a container. Roll-to-roll 3.68 times extension and thermal setting were performed on the undrawn yarns of about 30,000 filaments in 100 containers in a multi-stage horizontal thermal chamber to obtain Yarn for wigs 3 of 1,140,000 de/30,000 F (38 de/monofilament) having a total shrinkage of about 65% at a temperature of 130° C.

Examples 1 to 5 and Comparative Examples 1 to 4

Strands of Examples 1 to 5 (E1 to E5) and Comparative Examples 1 to 4 (CE 1 to CE 4) were prepared by using a preparation apparatus shown in FIG. 5.

The three types of Yarn for wigs were rewound around the winding rolls while being measured out into a subdivision of a desired number of filaments to place the yarns in the supply section. Then, the yarns were withdrawn from the winding rolls while rotational twists were applied to the yarns were withdrawn from each of the winding rolls, and then the yarns were passed through the thermal shrinking section whose temperature was set in consideration of a shrinkage of each of the yarns while controlling the tension applied to the filaments of the yarns in a proceeding direction by controlling the rotation speed of a pair of first nip rolls and the rotation speed of a pair of second nip rolls. Here, when needed, an appropriate flow rate of hot air was blown to the filaments in an upward direction perpendicular to the longitudinal direction of the filaments so as not to disturb autonomous self-shrinkage of the filaments. By this, in addition to having self-texture, the strand thus obtained has an appearance of spiral rotations. When the strand was cut into a cylindrical shape having a circular cross-section with a diameter of D and a length of 3D, a GLE (an embedded pencil-shape effect) and kinky coiling properties of the texture were compared according to various conditions of a product of the diameter D (unit: cm) and the number of spiral rotational twists (D*R).

The process conditions and the results of evaluation of Examples 1 to 5 and Comparative Examples 1 to 5 are shown in Tables 1 and 2.

In Tables 2 and 3, a ratio of a real density (RD) to a bulk density (BD) and physical properties of the filaments were evaluated as follows.

(1) Measurement of a Ratio of RD/BD

1) Measurement of BD

The strands obtained in Examples 1 to 5 and Comparative Examples 1 to 4 were appropriately cut to measure weights of the strands as well as lengths, widths, and thicknesses. BDs of the strands were obtained by using the measured weights and numerical values and calculated as follows.

$$\text{Bulk density (BD)} = \text{weight of strand}/\text{volume of strand}$$

2) Measurement of RD

RDs of the strands obtained from Examples 1 to 4 and Comparative Examples 1 to 5 were measured by a pycnometer method using a real density meter (AutoPycnometer1320 available from Micromeritics) and helium gas.

3) Measurement of RD/BD

The RDs obtained as described above were divided by the BDs to obtain the ratio of RD/BD.

(2) Measurement of Physical Properties of Filaments Sampled by the A Sampling Method and Physical Properties of Filaments Sampled by the B Sampling Method The strands were observed by using an SEM, obtaining samples by using the A sampling method and the B sampling method described above, and evaluating through image observation.

TABLE 1

| Item | | Strand preparation process | | | | | | | |
|---|---|---|---|---|---|---|---|---|---|
| | | Temperature of thermal shrinking section | RTM | | D*R | The number of Unit | Speed of | Speed of | Amount of vertical |
| | | ° C. | D cm | Number of rotation/m | cm *number of rotation/m | filaments Number | first roll m/min | second roll m/min | hot air $m^3$/min |
| Yarn | CE*1 | 120 | 0.15 | 150.0 | 22.5 | 100 | 25.0 | 15.0 | — |
| for | E*1 | 125 | 0.50 | 100.0 | 50.0 | 200 | 28.0 | 16.0 | 30 |
| wigs 1 | CE2 | 130 | 1.90 | 105.0 | 199.5 | 2500 | 30.0 | 18.0 | 10 |
| Yarn | CE3 | 130 | 0.70 | 270.0 | 189.0 | 600 | 25.0 | 12.5 | — |
| for | E2 | 135 | 1.00 | 46.0 | 46.0 | 500 | 28.0 | 14.5 | 45 |
| wigs 2 | E3 | 140 | 2.00 | 30.0 | 60.0 | 1500 | 30.0 | 16.0 | 60 |
| Yarn | E4 | 95 | 1.15 | 31.6 | 36.3 | 900 | 25.0 | 12.0 | 20 |
| for | E5 | 100 | 0.95 | 30.0 | 28.5 | 500 | 28.0 | 13.0 | 30 |
| wigs 3 | CE4 | 120 | 0.70 | 12.0 | 8.4 | 450 | 30.0 | 15.0 | 40 |

*CE: Comparative Example, E: Example

TABLE 2

| Item | | Physical property | Physical properties of A-sampled filaments | | | | | |
|---|---|---|---|---|---|---|---|---|
| | | of strand RD/BD ratio | IRw (0.05) | IRh (0.05) | Average base length (Mw) Unit | Average height (Mh) | Degree of uniformity of fine texture | Degree of fractal uniformity |
| | | — | % | % | mm | mm | % | % |
| Yarn | CE1 | 3.17 | 5.20 | 4.80 | 2.80 | 3.45 | 65 | 62 |
| for | E1 | 4.22 | 5.80 | 8.80 | 3.33 | 1.21 | 75 | 89 |
| wigs 1 | CE2 | 1.37 | 3.20 | 3.80 | 0.21 | 0.18 | 36 | 82 |
| Yarn | CE3 | 1.46 | 4.18 | 3.50 | 6.30 | 2.15 | 34 | 85 |
| for | E2 | 8.64 | 14.50 | 11.20 | 2.12 | 1.52 | 88 | 95 |
| wigs 2 | E3 | 18.14 | 18.20 | 9.80 | 3.12 | 3.35 | 94 | 92 |
| Yarn | E4 | 9.92 | 15.6 | 15.5 | 2.14 | 0.98 | 87 | 84 |
| for | E5 | 18.25 | 18.7 | 16.2 | 1.21 | 0.58 | 92 | 82 |
| wigs 3 | CE4 | 29.40 | 13.7 | 12.4 | 3.21 | 2.55 | 95 | 60 |

TABLE 3

| Item | | Physical properties of B-sampled filaments Gradient-length effect (Embedded pencil-shape effect) Unit | | | |
|---|---|---|---|---|---|
| | | L (FIG. 4A) | α | β | γ |
| Yarn | CE 1 | 0.67 | 0.64 | 0.67 | 0.97 |
| for | E 1 | 2.59 | 2.56 | 2.59 | 1.40 |
| wigs 1 | CE 2 | 16.04 | 16.03 | 16.04 | 1.88 |
| Yarn | CE 3 | 15.06 | 15.06 | 15.06 | 1.87 |
| for | E 2 | 2.27 | 2.25 | 2.27 | 1.36 |
| wigs 2 | E 3 | 3.40 | 3.38 | 3.40 | 1.48 |
| Yarn | E 4 | 1.55 | 1.53 | 1.55 | 1.27 |
| for | E 5 | 1.03 | 1.00 | 1.03 | 1.19 |
| wigs 3 | CE 4 | 0.10 | 0.06 | 0.10 | 1.01 |

Referring to Tables 1 to 3, a thickness of the strand prepared in Comparative Example 1 is too small, and an irregularity of the texture was somewhat not enough. A degree of uniformity of fine texture or occupancy rate of fine texture and a uniformity of fractal structure (%) were each lower than 70%, and thus overall the filaments in the strand did not generally exhibit uniform kinky fractal texture. Here, the degree of uniformity of fine texture or occupancy rate of fine texture is defined as a percentage of the length of a section having a base (W) in a range of 0.25 mm or more to less than 6.5 mm and a height (H) in a range of 0.25 mm or more to less than 6.5 mm based on 250 cm of a section of the filaments sampled using the A sampling method described above. The degree of fractal uniformity denotes a percentage of the length of a section having a fractal structure based on 250 cm of a section of the filaments sampled using the A sampling method described above.

The strand of Comparative Example 2 had a D*R value that was too high that the irregularity and the volume density were low. The texture was off the range of a kinky texture, and the degree of uniformity of fine texture was less than 70%, which resulted a kinky texture generally not uniform.

The strand of Comparative Example 3 had a D*R value that was too high that the irregularity and the volume density were low. A base length of the texture was off the range of a kinky texture, and the degree of uniformity of fine texture was less than 70%, which resulted a kinky texture generally not uniform.

The strand of Comparative Example 4 had a D*R value that was too low that a GLE (embedded pencil-shape effect) was not enough. The filaments bundled in the strand did not generally have fractal structure characteristics.

On the contrast, the strands prepared in Examples 1 to 4 which satisfy the parameters of the present invention had filaments, wherein the filaments generally had a uniform kinky fractal texture and a good GLE, and a volume density of the strands was excellent as well.

As discussed above, the embodiments may be used in preparation of filaments for wigs and preparation of wigs using the filaments.

What is claimed is:

1. A strand for wigs extending in one direction, the strand comprising:

40 to 4,000 filaments of one or more types, wherein each of the filaments comprises an amorphous organic polymer, a semi-crystalline organic polymer, or an alloy thereof, wherein an external diameter D of a cross-section of the strand is in a range of 0.2 centimeters (cm) or more to 3.0 cm or less, the strand overall has spiral waveforms caused by spiral rotational twists, wherein when the number of spiral rotational twists per meter is R (unit: number of rotation/m), a product of D and R (D*R) is 180 (unit: cm ·number of rotation/m) or less, a ratio of a real density (RD) to a bulk density (BD) of the strand which determines an appearance of the strand and varies based on a self-texture and R, is 1.5 or more to 40 or less, wherein each of the filaments forms a plurality of windings having irregular shapes and sizes, wherein when waves formed by the plurality of windings are observed by a scanning electron microscope (SEM), the waves are in irregular waveforms having irregular amplitudes and wavelengths;

wherein when the total number of the windings is N, a base of a triangle formed by connecting troughs and a peak of an $i^{th}$ winding of each of the filaments is Wi, a height of the triangle of the $i^{th}$ winding is Hi, an average base of triangles of the windings is Mw=sum(Wi, where $1 \le i \le N$)/N, and an average height of the triangles of the windings is Mh=sum(Hi, where $1 \le i \le N$)/N, and when functions IR(P) each representing a percentage of windings +/−P% or more off from Mw and Mh are respectively defined as IRw(P)=sum(F(Wi), where $1 \le i \le N$)/N and IRh(P) =sum(F(Hi), where $1 \le i \le N$)/N, the strand has an irregular texture that satisfies the condition of IRw(0.05)≥0.05 or IRh(0.05)≥0.05;

wherein, in the definition of the function IRw(P), when x≥(1+P)*Mw or x≤(1−P)*Mw, F(x)=1; or otherwise, F(x)=0;

wherein in the definition of the function IRh(P), when x≥(1+P)*Mh or x≤(1−P)*Mh, F(x)=1; or otherwise, F(x)=0;

wherein a value of the function IR(P) is obtained from an A sampling section having a total length of 250 cm, wherein the A sampling section is obtained by adding the sums of hypotenuses of the triangles observed in each filament of ten filaments, in which the sum of hypotenuses of the triangles observed in each filament is selected to be 25 cm, wherein each of the ten filaments is randomly sampled at random locations in the strand having a randomly sampled length of 30 cm;

wherein the triangles each formed by connecting troughs and a peak of each of the windings in the A sampling section has an average base in a range of 0.25 millimeters (mm) or more to less than 6.5 mm and an average height in a range of 0.25 mm or more to less than 6.5 mm.

2. The strand for wigs of claim 1, wherein when evaluated against the A sampling section, the irregular texture and the spiral waveform waveforms caused by spiral rotational twists of the filaments of the strand form a fractal structure, wherein the spiral waveforms forming the fractal structure is a 3-dimensional waveform.

3. The strand for wigs of claim 2, wherein a characteristic of the fractal structure is that the windings of the filaments and the spiral waveforms proceed in the same direction.

4. The strand for wigs of claim 1, wherein the irregular texture and the spiral waveforms caused by spiral rotational twists forms a fractal structure in 70% or more of the A sampling section.

5. The strand for wigs of claim 1, wherein when the strand is cut into a cylindrical shape having a circular cross-section with a diameter D and a length equal to the length three (3) times the diameter D, 3*D, the D*R of the strand is in a range of 20 or more to 180 (unit: cm · number of rotation/m) or less.

6. The strand for wigs of claim 1, wherein the triangles each formed by connecting troughs and a peak of each of the windings in the A sampling section has an average base in a range of 0.25 mm or more to less than 4.5 mm.

7. The strand for wigs of claim 1, wherein the triangles each formed by connecting troughs and a peak of each of the windings in 70% or more of the A sampling section has a base in a range of 0.25 mm or more to less than 6.5 mm and a height in a range of 0.25 mm or more to less than 6.5 mm.

8. The strand for wigs of claim 1, wherein the triangles each formed by connecting troughs and a peak of each of the windings in 70% or more of the A sampling section has a base in a range of 0.25 mm or more to less than 4.5 mm.

9. The strand for wigs of claim 1, wherein when the filaments forming the strand are aligned in a longitudinal direction while spreading the filaments by applying a force thereon, the filaments in a center portion of a cross-section of the strand are extended the shortest in the longitudinal direction, the filaments are extended further than an original length of the strand in the longitudinal direction as the filaments are further away from the center portion in a radial direction perpendicular to the longitudinal direction of the cross-section of the strand, and, as a result, a shape of the line resulting from connecting fore-endings of the filaments is in a reversed V-shape when the filaments extending in the longitudinal direction are spread side by side in the longitudinal direction.

10. The strand for wigs of claim 9, wherein when the filaments extending in the longitudinal direction are collected to the center line, which is in the longitudinal direction and passes through the center of the cross-section of the strand, fore-endings of the filaments form a circular cone shape, and a vertex of the circular cone is on the center line.

11. The strand for wigs of claim 10, wherein when the strand is cut into a cylindrical shape having a circular cross-section with a diameter D and a length equal to 3D, a length L extending beyond the original length 3D of the strand is 0.5D or more as the filaments in an outermost sheath side of the strand are spread in the longitudinal direction, wherein the outermost sheath side of the strand corresponds to the most distant portion of the strand from the center.

12. The strand for wigs of claim 1, wherein the strand comprises 40 to 4,000 filaments of one type, wherein each of the filaments comprises an amorphous organic polymer, a semi-crystalline organic polymer, or an alloy thereof.

13. The strand for wigs of claim 1, wherein each of the strands is separated from or combined to one another or each other.

14. The strand for wigs of claim 1, wherein the strand has a circular or flat cross-section.

15. The strand for wigs of claim 13, wherein when the combined strands are separated to each of the strands, they form curls in the strands by intertwisting.

16. The strand for wigs of claim 1, wherein a length of the strand is 0.5 meter (m) or more.

17. The strand for wigs of claim 16, wherein the filaments of the strand for wigs consist of filaments of one type.

18. The strand for wigs of claim 16, wherein the filaments of the strand for wigs comprise filaments of two types or more having different shrinkages.

* * * * *